United States Patent [19]

Marchetti

[11] Patent Number: 5,025,608

[45] Date of Patent: Jun. 25, 1991

[54] TAPING MACHINE FOR PARALLELEPIPED CARDBOARD BOXES TO BE SEALED ALONG THE SIDES

[76] Inventor: Augusto Marchetti, Piazza Sicilia, 7, 20146 Milano, Italy

[21] Appl. No.: 493,341

[22] Filed: Mar. 14, 1990

[30] Foreign Application Priority Data

Mar. 15, 1989 [IT] Italy ..... 19776 A/89

[51] Int. Cl.[5] ..... B65B 61/00; B31B 1/72

[52] U.S. Cl. ..... 53/135.1; 53/415; 493/117; 493/121; 493/478; 156/468; 156/486; 156/523

[58] Field of Search ..... 493/116, 117, 121, 147, 493/382, 383, 478, 479; 53/137, 415; 156/360, 523, 468, 475, 486

[56] References Cited

U.S. PATENT DOCUMENTS

| | | | |
|---|---|---|---|
| 3,253,383 | 5/1966 | Miller et al. | 156/486 |
| 3,282,018 | 11/1966 | Bixley | 53/137 |
| 4,541,888 | 9/1985 | Marchetti | 156/468 |
| 4,542,616 | 9/1985 | Ulrich et al. | 53/137 |
| 4,543,150 | 9/1985 | Marchetti | 53/137 |
| 4,551,194 | 11/1985 | Marchetti | 53/137 |
| 4,748,794 | 6/1988 | Marchetti | 493/478 |
| 4,781,786 | 11/1988 | Lerner et al. | 156/468 |

*Primary Examiner*—Frederick R. Schmidt
*Assistant Examiner*—John A. Marlott
*Attorney, Agent, or Firm*—Cushman, Darby & Cushman

[57] ABSTRACT

A taping machine comprising an operating and advancement plane for boxes to be side-sealed. The apparatus includes conveyors engaging the top and bottom of the boxes to cause advancement. The upper conveyor is displaceable vertically, while the taping units are displaceable vertically and horizontally. The transmission of motion is operationally but removably placed between the conveyor and taping unit adjustment devices. This motion is such that every vertical displacement of the conveyor implies a similar halved displacement of the taping units. The result is ease of adjustment for boxes of differing sizes.

4 Claims, 6 Drawing Sheets

TAPING MACHINE FOR PARALLELEPIPED CARDBOARD BOXES TO BE SEALED ALONG THE SIDES

The present invention relates to a taping machine for parallelepiped cardboard boxes to be sealed along the sides.

Normally, cardboard boxes appear at the taping machine with sealing flaps on the top and on the bottom of the box.

It does, however, occur that special boxing requirements of the products demand that the boxes be arranged with the sealing flaps along the sides. This clearly implies the impossibility of using the usual kind of taping machines for those boxes.

Taping machines are already known for boxes with sealing flaps along the sides, which comprise an operating and advancement plane for the boxes, means for grasping them which can engage the top and the bottom of the boxes so as to cause the advancement of the boxes themselves along said operating plane and a pair of supports for taping units available on opposite sides of said operating plane to carry out the application of respective sections of adhesive tape along the junction slots formed between the sealing flaps, which have already been folded over, of the boxes.

A drawback of the above known machines is connected with the fact that, as the height of the boxes introduced into the machine varies, the height of the slot varies correspondingly by one half. In the known machines this implies the need for carrying out two adjustments for each change of box size, one for the means for grasping the boxes and the other for the taping units. This causes problems of time and accuracy of adjustment, which are hardly compatible with the need for optimizing the packaging operation.

The object of the present invention is, on the other hand, that of accomplishing a taping machine for parallelepiped cardboard boxes sealed along the sides, whereby it is possible to carry out the adjustment operations which depend on the height of the box with a single action.

According to the invention such object is attained with a taping machine comprising an operating and advancement plane for the boxes, first and second means for grasping the boxes which can engage the top and the bottom of the boxes, respectively, to cause the advancement of the boxes themselves along said operating plane, a vertically displaceable support for said first grasping means, first means for the adjustment of the vertical position of said vertically displaceable support, a pair of vertically and horizontally displaceable supports for taping units which can engage the sides of the boxes for the application of respective sections of adhesive tape along the junction slots between the folded sealing flaps of the boxes, second means for the adjustment of the vertical position of said pair of vertically and horizontally displaceable supports and third means for the adjustment of the horizontal position of said pair of supports, characterized in that it comprises means for the transmission of motion placed operationally between said first and second adjustment means so that every vertical displacement of said vertically displaceable support automatically implies a similar halved vertical displacement of said pair of supports.

In this way a single action taken on the means for adjusting the height of the grasping means of the boxes allows the simultaneous adjustment in height, with a correctly halved displacement, of the taping units.

If so desired, the present invention provides the possibility of doing away with the mechanical transmission between the first and the second adjustment means so that the two adjustments may be made to be independent. This, for example, may prove useful in the application of supplementary sections of adhesive tape at heights intermediate between the center line and the outer edges of the boxes.

These and other characteristics of the present invention shall be made evident by the following detailed description of a possible embodiment illustrated as a non-limiting example in the enclosed drawings, wherein.

With reference to FIGS. 1 to 5, there is shown a taping machine which comprises a basement chassis 1 on which there is defined an operating and advancement plane 2 for the boxes to be subjected to taping.

Figure 2:
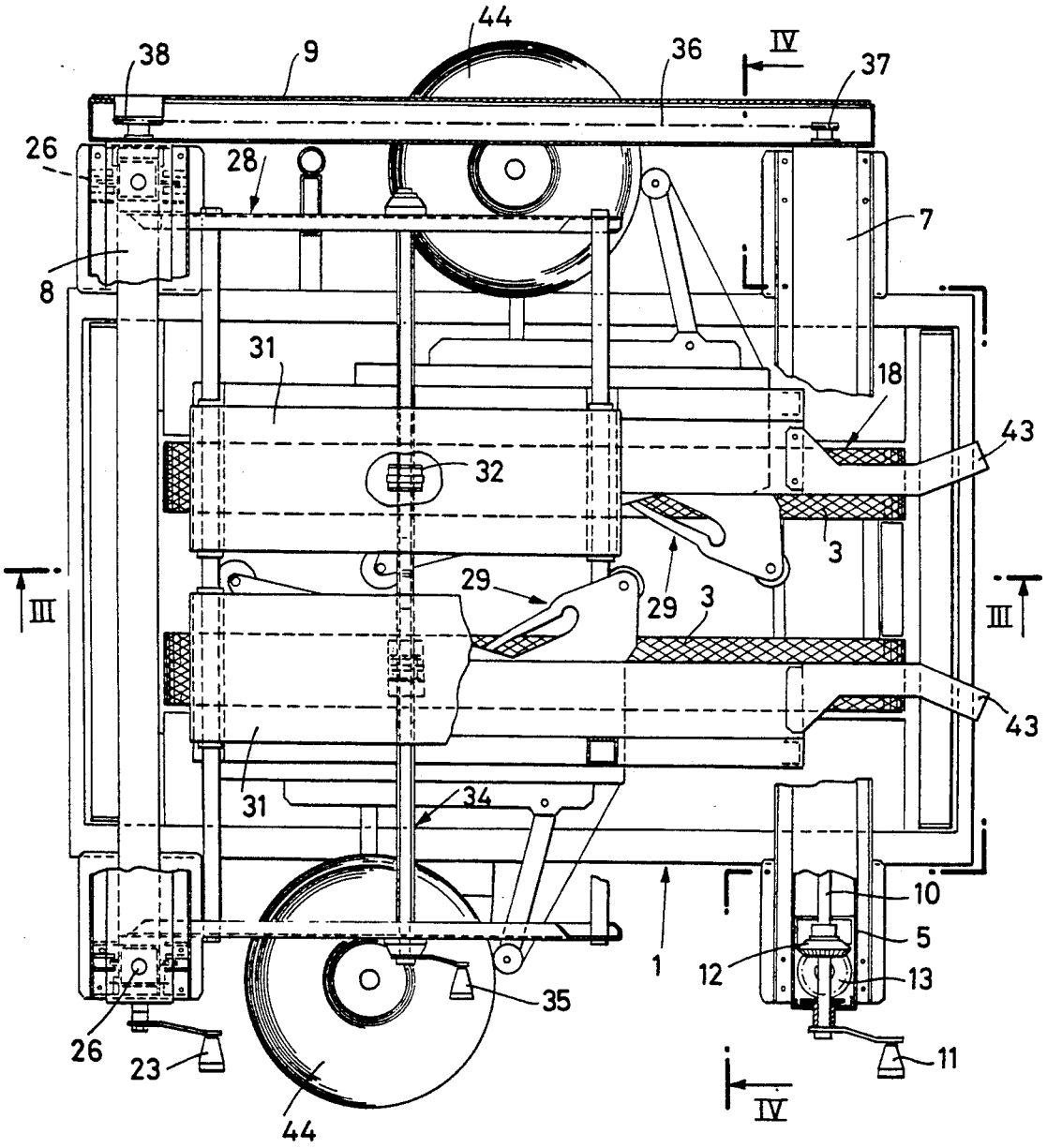
FIG. 2 shows the same machine in a plan view from above with parts removed.
Figure 3:
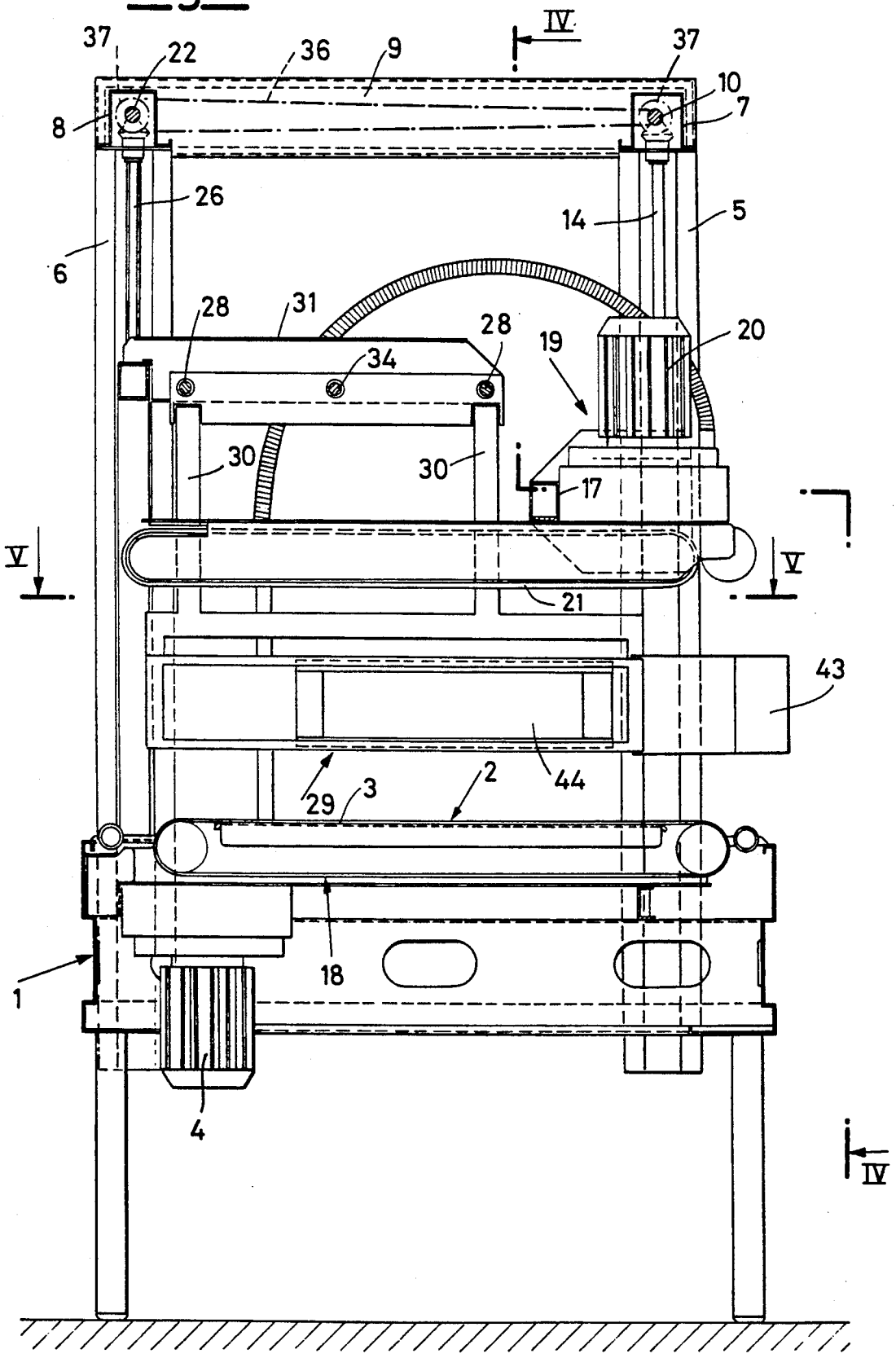
FIG. 3 shows a longitudinal cross-sectional view of said taping machine taken along the line III—III of FIGS. 1 and 2.
Figure 5:
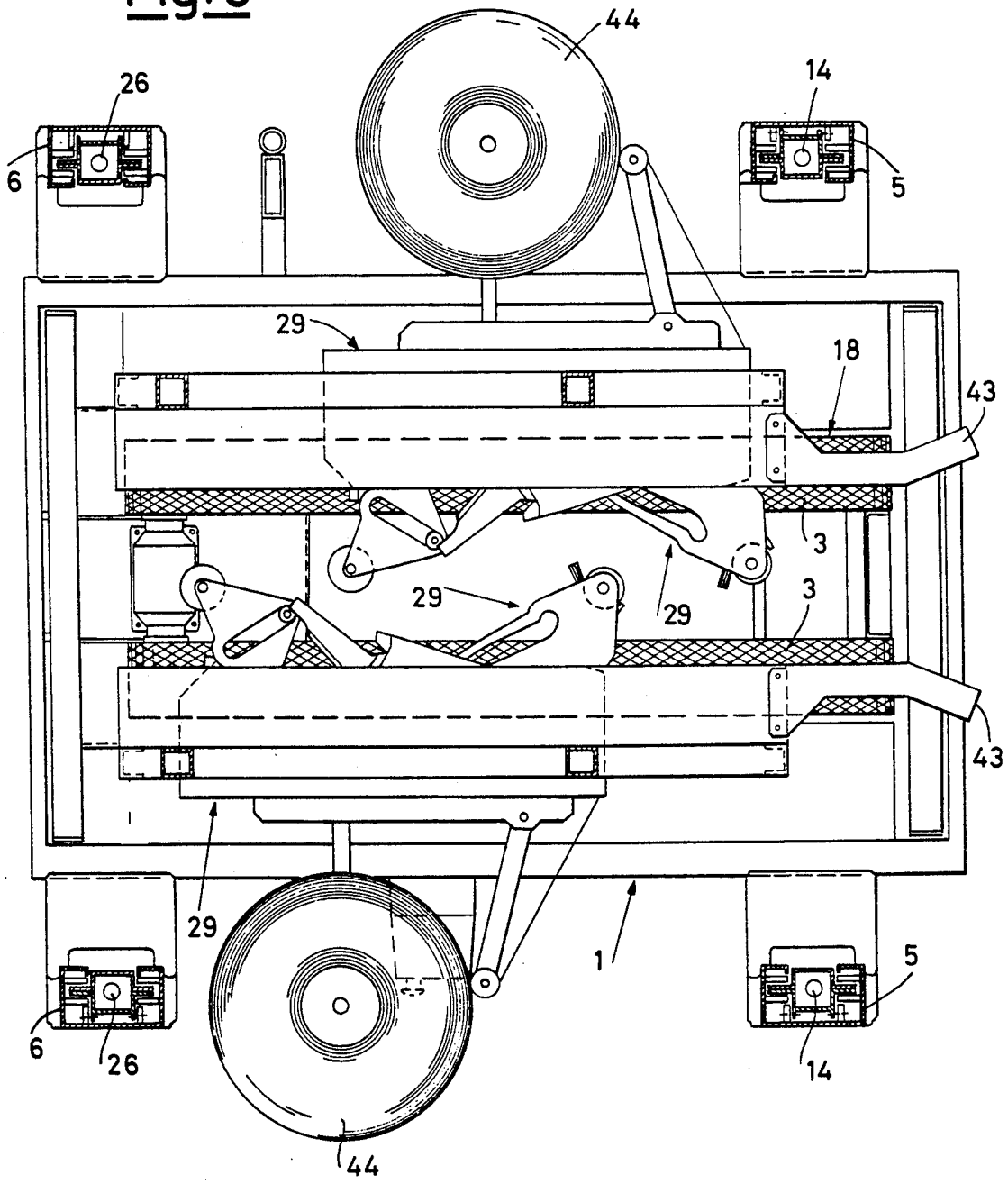
FIG. 5 shows said machine sections along the line V—V of FIGS. 1 and 3.

In plane 2 there is incorporated a motorization unit 18 formed by a pair of rubber belts 3, operated by a motor 4 (FIG. 3), which engaging by means of a clutch the bottom wall of the boxes, determine their advancement along operating plane 2 from right to left as one looks at FIGS. 2, 3 and 5.

Figure 4:
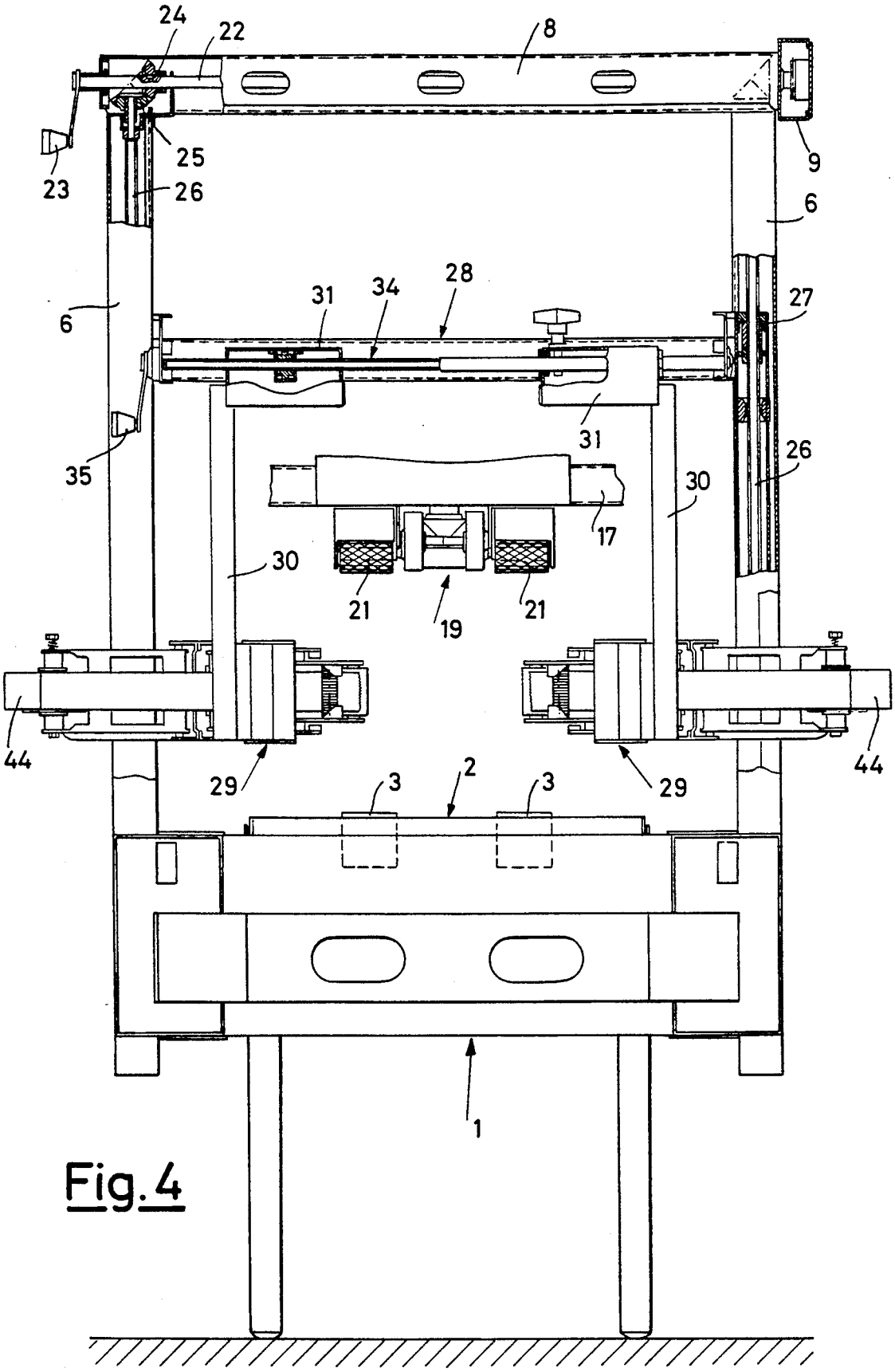
FIG. 4 shows a transverse cross-sectional view of said machine taken along the line IV—IV of FIGS. 2 and 3.

From the sides of operating plane 2 there extend upwards two pairs of front uprights 5 and rear uprights 6 connected at the top by a front beam 7, by a rear beam 8 and by a side beam 9 (FIGS. 2 to 4).

Figure 1:
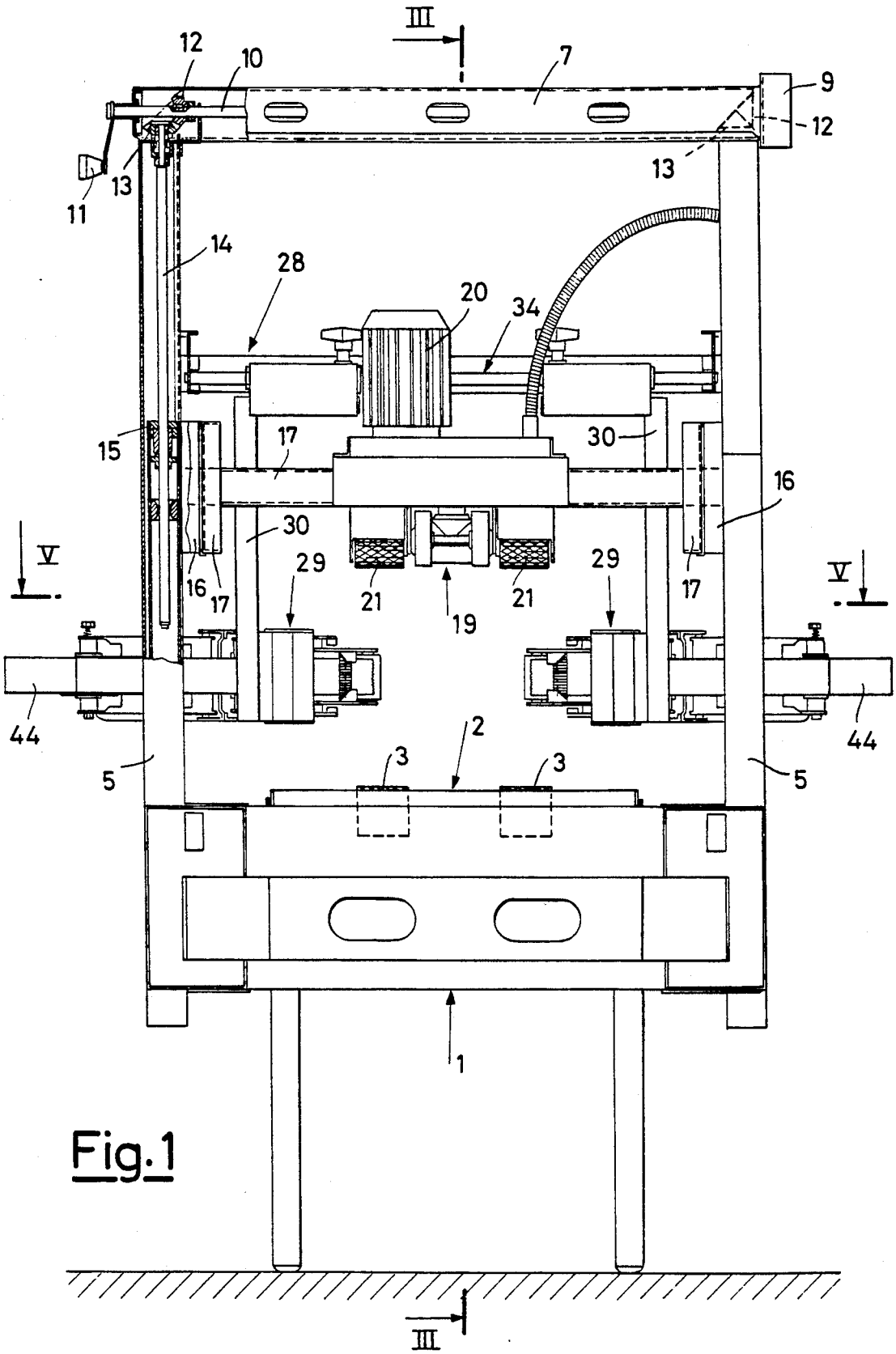
FIG. 1 shows a front view of a taping machine according to the invention.
Figure 6:
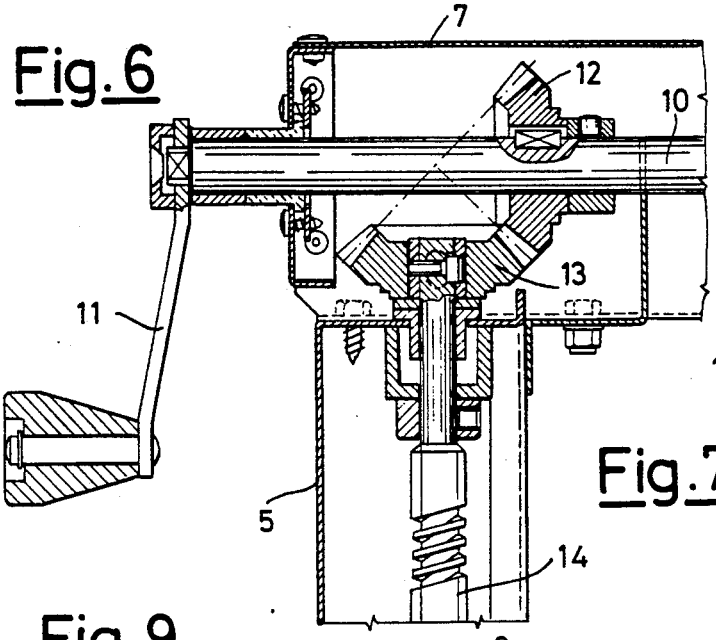
FIGS. 6 to 10 show in an enlarged scale some construction details of the taping machine illustrated in the preceding figures.
Figure 7:
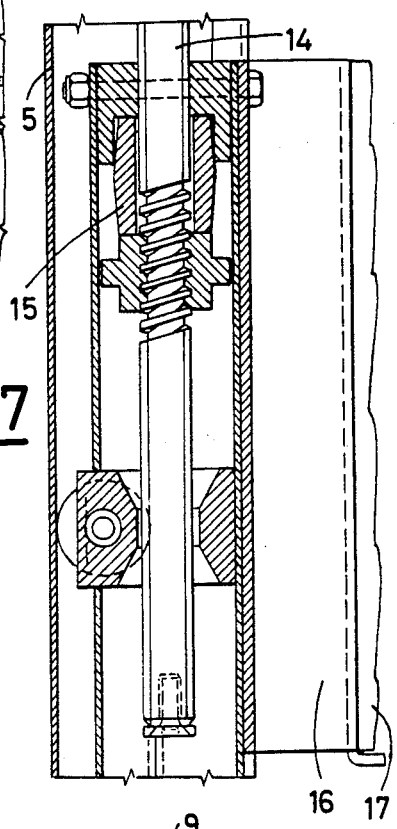

A shown in FIGS. 1 and 2, a shaft 10 is rotatably housed in front beam 7 which may be made to rotate by means of a small external operating handwheel 11. By means of two pairs of bevel gears 12, 13, one of which is illustrated better in FIG. 6, the rotation of shaft 10 is transmitted to two vertical threaded bars 14 rotatably housed in front uprights 5. By means of respective nut screws 15 slidably housed inside the same front uprights, one of which is illustrated better in FIG. 7, the rotation of said threaded bars 14 translates into a vertical movement of a pair of brackets 16 to which are attached the extremities of a mobile beam 17 supporting a further motorization unit 19 formed by a motor 20 and by a pair of rubber belts 21 which can engage the upper wall of the boxes. Shaft 10 with small handwheel 11, the pairs of bevel gears 12, 13, the threaded bars 14 and the nut screws 15 thus form an adjustment system by means of which the vertical position of the upper motorization unit 19 may be adjusted to the height of the boxes to be taped.

As shown on the other hand in FIGS. 2 and 4, a shaft 22 is in turn rotatably housed in the rear upright 8 which may be operated in rotation by means of a small external operating handwheel 23. By means of two pairs of bevel gears 24 and 25 the rotation of shaft 22 is transmitted to two vertical threaded bars 26 rotatably housed in rear uprights 6. By means of respective nut screws 27 slidably housed in the same uprights and which are altogether similar to nut screws 15 described above, the rotation of threaded bars 26 translates into the vertical displacement of a chassis 28 supporting the vertically displaceable pair of taping units 29 which in turn are horizontally displaceable with respect to said chassis 28 so as to get closer to and move away from each other in relation to the width of the boxes to be taped.

Figure 8:
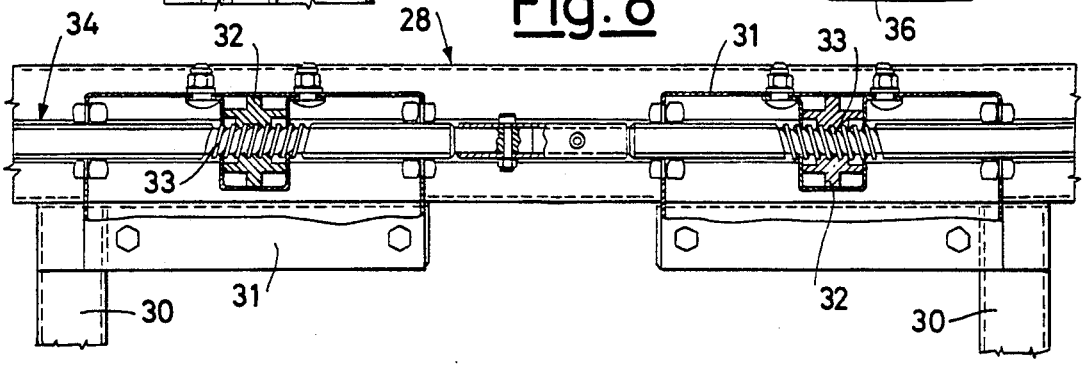

More precisely, as shown in FIGS. 2 and 4 and in greater detail in FIG. 8, the two taping units 29 are sustained by respective supporting arms 30, which extend downward from respective slidable plates 31 supported by chassis 28. To the plates 31 there are fastened respective nut screws 32 (FIG. 8), which engage respective inversely threaded portions 33 of a horizontal shaft 34 rotatably supported by chassis 28 and provided with a small operating handwheel 35.

With the small handwheel 35 it is thus possible to adjust the reciprocal distance between the two taping units, just as with the previously described small handwheel 23 it is possible to adjust their height with respect to the operating plane 2 of the boxes.

Figure 9:
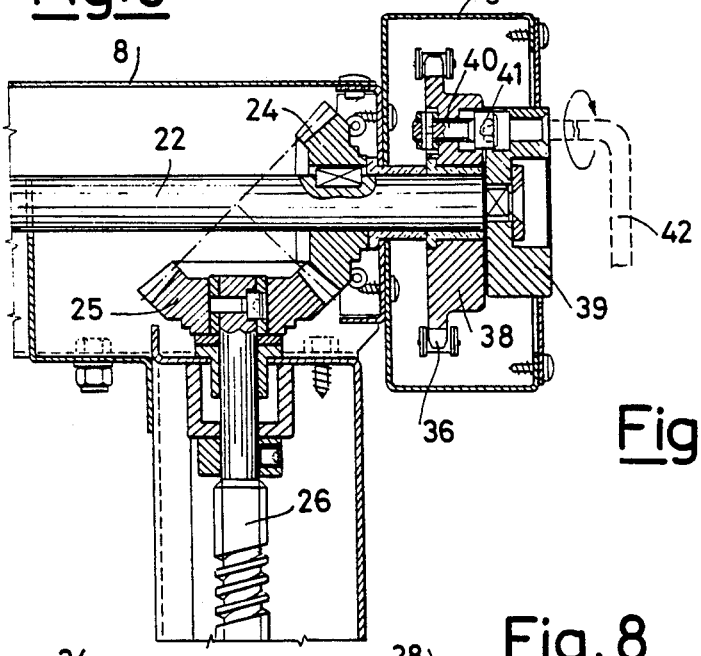
Figure 10:
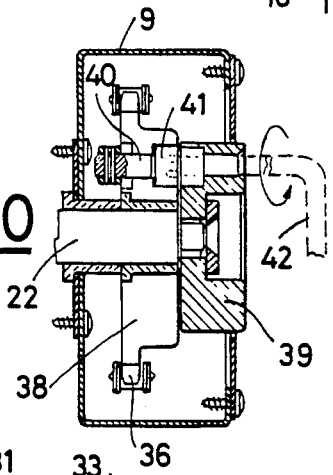

Finally, the beam 9 acts as a housing for a motion transmission chain 36 which engages two pinions 37 and 38, the first of which is keyed on shaft 10 of the system for adjusting the height of the upper motorization unit 19 and the second, having twice the circumference of the first so as to accomplish a transmission ratio of 2:1, mounted in a freely rotatable way on shaft 22 of the system for adjusting the height of taping units 29. As shown in FIGS. 9 and 10, pinion 38 may be made integral with shaft 22 by means of an extremity block 39 of the latter (FIG. 9) or left unconstrained from it (FIG. 10) according to the axial position of a threaded pin 40 provided with a polygonal head 41 which may be engaged by a normal socket head wrench 42. In the first case every adjustment in the height of the upper motorization unit 19, carried out in relation to the height of the boxes to be taped, is automatically accompanied by a simultaneous adjustment in height, by an amount of one half, of taping units 29; in this way the taping units are always positioned correctly on the center-line of the boxes' open sides, where the junction slot between the sealing flaps is normally present. But in the second case the adjustment of the height of the taping units remains independent and is carried out by means of small handwheel 23, say for applying tape in an asymmetrical position for reasons of reinforcement of weakened areas or for whatever other cause.

In operation, once the vertical position of the upper motorization unit 19 has been set as well as having, automatically or otherwise, as already said, set the vertical position of taping units 29, the horizontal adjustment of the same taping units is carried out by means of small handwheel 35. That done, the various boxes to be taped are introduced one by one on the operating plane 2, with their bottom and top walls engaging the two motorization units 18 and 19. These cause the advancement of the boxes along the operating plane, in a central position with respect to the plane itself thanks to entry guides 43 (FIGS. 2, 3 and 5). The sides of the boxes with their flaps folded over then engage the two taping units 29, suitably staggered in a longitudinal direction to permit them to get as close as possible to one another for processing very narrow boxes, and receive from them sections of adhesive tape withdrawn in a known way from respective feed rolls 44 (FIGS. 2 to 5).

I claim:

1. Taping machine comprising an operating and advancement plane for the boxes, first and second means for grasping the boxes which can engage the top and the bottom of the boxes, respectively, to cause the advancement of the boxes themselves along said operating plane, a vertically displaceable support for said first grasping means, first means for the adjustment of the vertical position of said vertically displaceable support, a pair of vertically and horizontally displaceable supports for taping units which can engage the sides of the boxes for the application of respective sections of adhesive tape along the junction slots between the folded sealing flaps of the boxes, second means for the adjustment of the vertical position of said pair of vertically and horizontally displaceable supports and third means for the adjustment of the horizontal position of said pair of supports, and further comprising means for the transmission of motion placed operationally between said first and second adjustment means so that every vertical displacement of said vertically displaceable support automatically implies a similar halved vertical displacement of said pair of supports.

2. Machine according to claim 1, further comprising means for the interruption of said means for the transmission of motion.

3. Machine according to claim 2, characterized in that said means for the transmission of motion comprise a first pinion mounted integrally on a first shaft for the adjustment of the vertical position of said vertically displaceable support, a second pinion having twice the circumference which may be made integral for rotation with a second shaft for the adjustment of the vertical position of said pair of vertically and horizontally displaceable supports and a chain connecting said pinions.

4. Machine according to claim 3, characterized in that said means for the interruption of the transmission of motion comprise a connecting pin placed removably between said second pinion and said second adjustment shaft.

* * * * *